United States Patent [19]

Belanger

[11] Patent Number: 4,787,274

[45] Date of Patent: Nov. 29, 1988

[54] INSTALLING TOOL FOR WEDGING-TYPE FASTENERS

[75] Inventor: Victor Belanger, Huntington Beach, Calif.

[73] Assignee: Monogram Industries, Inc., Culver City, Calif.

[21] Appl. No.: 5,386

[22] Filed: Jan. 9, 1987

Related U.S. Application Data

[63] Continuation of Ser. No. 717,947, Mar. 29, 1985, abandoned.

[51] Int. Cl.[4] ..... B25B 13/00

[52] U.S. Cl. ..... 81/59.1; 81/57.15

[58] Field of Search ..... 81/57.15, 59.1, 55

[56] References Cited

U.S. PATENT DOCUMENTS

| | | | |
|---|---|---|---|
| 1,033,049 | 7/1912 | Chase . | |
| 1,242,201 | 10/1917 | Keller . | |
| 1,412,688 | 4/1922 | Layton . | |
| 1,511,226 | 10/1924 | Lawrence . | |
| 1,609,086 | 11/1926 | Hurschmann . | |
| 1,878,053 | 9/1932 | Winger . | |
| 1,904,621 | 4/1933 | Kounovsky . | |
| 2,387,371 | 10/1945 | Wallace . | |
| 2,408,335 | 9/1946 | Oliver et al. . | |
| 2,550,010 | 4/1951 | Kavalar . | |
| 2,896,488 | 7/1959 | Ahana . | |
| 2,897,932 | 8/1959 | Morgan . | |
| 3,007,504 | 11/1961 | Clark . | |
| 3,162,072 | 12/1964 | Steward | 81/55 |
| 3,233,504 | 2/1966 | Jones . | |
| 3,260,151 | 7/1966 | Jones . | |
| 3,263,320 | 8/1966 | Jones | 81/55 |
| 3,289,525 | 12/1966 | Lee . | |
| 3,331,268 | 7/1967 | Jones et al. | 81/55 |
| 3,426,399 | 2/1969 | Jones . | |
| 3,568,562 | 3/1971 | Harwood | 269/47 |
| 3,590,667 | 7/1971 | Berglein | 81/59.1 |
| 3,908,487 | 9/1975 | Plaw | 81/59.1 |
| 4,408,504 | 10/1983 | Dobosh | 81/59.1 |
| 4,537,542 | 8/1985 | Pratt | 411/55 |
| 4,548,533 | 10/1985 | Pratt | 411/55 |

FOREIGN PATENT DOCUMENTS

| | | |
|---|---|---|
| 647647 | 7/1937 | Fed. Rep. of Germany . |
| 680232 | 8/1939 | Fed. Rep. of Germany . |
| 712337 | 10/1941 | Fed. Rep. of Germany . |
| 803986 | 10/1936 | France . |
| 887862 | 11/1943 | France . |
| 533984 | 2/1941 | United Kingdom . |

*Primary Examiner*—Frederick R. Schmidt
*Assistant Examiner*—Maurina Rachuba
*Attorney, Agent, or Firm*—Pretty, Schroeder, Brueggemann & Clark

[57] ABSTRACT

An installing tool having two way drive wrench portion particularly suited for installing wedge-locking type aircraft fasteners. The wrench portion is adapted to be installed on a driving tool. The wrench portion has at least a forwardly and a rearwardly mounted polygonally-shaped opening with a cage in each opening, each cage having a plurality of rollers mounted therein and loosely mounted within the polygonally shaped openings but retained therein. In operation, the wrench portion is placed over the fastener it is desired to install, the main body of the fastener, which may be cylindrical, entering the forward polygonally-shaped opening in the wrench portion and abutting against the rollers thereon which protrude inwardly toward the fastener. A nut portion of the fastener, which may be cylindrical, enters the rear opening. Rotation of the nut portion while holding the main body portion results in installation of the fastener without need for precise alignment of the wrench to the fastener. This is because the loosely mounted cage adjusts for any misalignment and the rollers abut against the walls of the polygonally-shaped opening to wedge or lock the wrench to the fastener. After installation, the relaxation of the engagement of the tool to the fastener allows for easy withdrawal.

9 Claims, 2 Drawing Sheets

INSTALLING TOOL FOR WEDGING-TYPE FASTENERS

This application is a continuation, of application Ser. No. 717,947, filed 3/29/85, now abandoned.

BACKGROUND OF THE INVENTION

1. Field of the Invention

The invention relates to installing tools; and, more particularly, to a tool for installing fasteners particularly wedging-type fasteners having cylindrical bodies.

2. Description of the Prior Art

Various types of wrenches are known in the art. Generally, such wrenches are either adjustable to grip the part being installed or otherwise turned, or of a fixed irregular inner configuration of the device which it is desired to grip. In the aircraft industry, when it is desired to secure two panels together, apertures are made in these panels and devices, known as wedging-type fasteners, are temporarily installed in aligning apertures in the panels at pre-determined locations. Such installation is usually carried out quickly and, preferably, automatically. The fasteners are later removed after installation of more permanent fasteners.

It is desired that the installer carry a suitable tool to effect such installation. It is necessary, with known tools and fasteners, to carefully align the wrenching portion of the tool to the fastener body to effect both proper installation and withdrawal after installation. This is a particular problem where the fastener body is not cylindrical. When the body of the fastener is cylindrical, conventional wrenching tools cannot be used to grip the cylindrical fastener body.

In U.S. Pat. No. 2,719,447 to Ford, a wrench head in a ratchet wrench is disclosed having spring-biased rollers used to rotate a hexagonally-shaped nut. Since member 58 is in direct meshing engagement with wheel 24, it does not appear that the tool of Ford could be used to rotate a cylindrically-shaped nut since there would not be any wedging action. A round nut would merely turn within the jaws of member 58.

In U.S. Pat. No. 1,589,736 to Bell, a workpiece A of round cross-section is rotated between dies having teeth. Such tool is quite complex, and the teeth must dig into the piece to rotate it.

Similar complex devices are disclosed in U.S. Pat. Nos. 2,613,565 and 2,613,942 to Saunders and 3,889,557. These prior art devices are relatively expensive and difficult to use.

U.S. Pat. Nos. 3,331,268; 3,263,320; and 3,162,072 all show tools used to install wedging-type fasteners. The bodies of all the fasteners are irregularly shaped and easily gripped by the wrench portion of the tool.

There is thus a need for a tool having a wrenching portion that is capable of installing cylindrical body fasteners in an inexpensive and simple manner without need for precise alignment between the fastener and the wrench.

SUMMARY OF THE INVENTION

It is an object of this invention to provide an improved tool for installing fasteners.

It is a further object of this invention to provide a tool having a drive wrench portion uniquely suited for installing wedging-type fasteners having cylindrical bodies.

These and other objects are preferably accomplished by providing tool having a wrenching portion at one end. The wrenching portion has at least a forwardly and a rearwardly mounted polygonally-shaped opening with a cage in each opening, each cage having a plurality of rollers mounted therein and loosely mounted within the polygonally shaped openings but retained therein. In operation, the wrenching portion is placed over the fastener it is desired to install, the main body of the fastener, which may be cylindrical, entering the forward polygonally-shaped opening in the wrenching portion and abutting against the rollers thereon which protrude inwardly toward the fastener. A nut portion of the fastener, which may be cylindrical, enters the rear opening. Rotation of the nut portion while holding the main body portion results in installation of the fastener without need for precise alignment of the wrnech to the fastener. This is because the loosely mounted cage adjusts for any misalignment and the rollers abut against the walls of the polygonally-shaped opening to wedge or lock the wrench to the fastener. After installation, the relaxation of the engagement of the tool to the fastener allows for easy withdrawal.

DESCRIPTION OF THE PREFERRED EMBODIMENT

Figure 1:
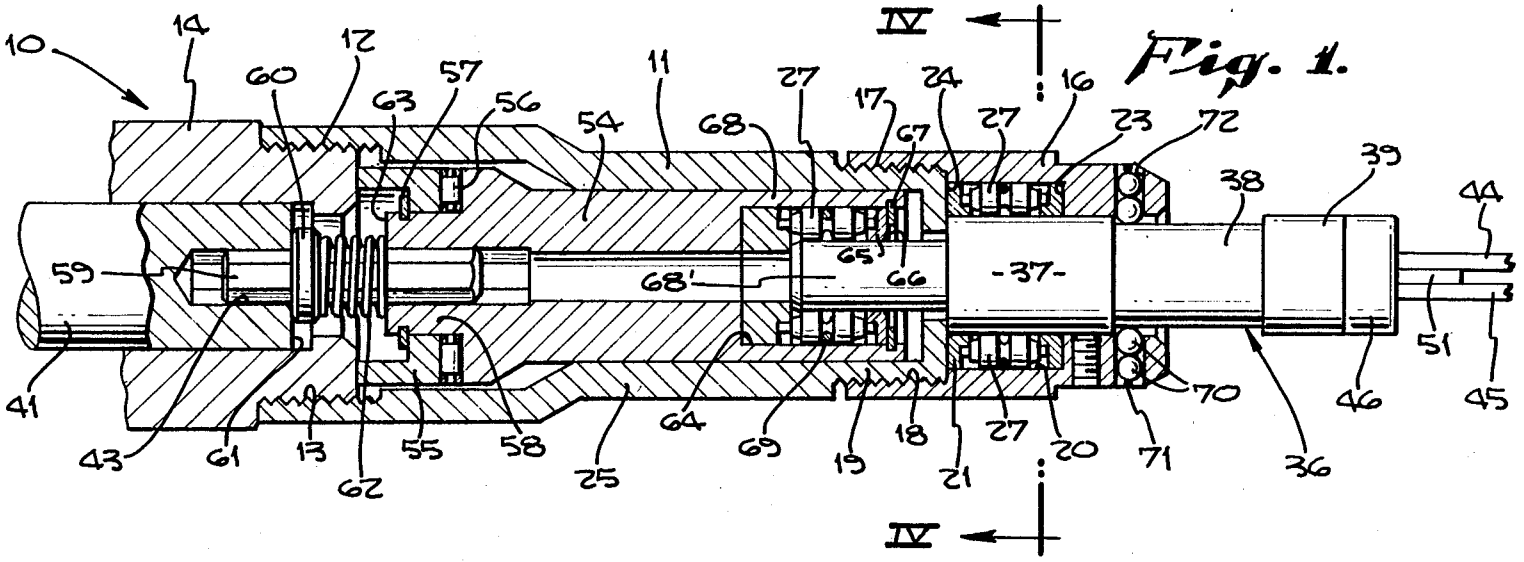
FIG. 1 is a vertical partly cross-sectional view of a portion of an installing tool having a wrench portion thereon in accordance with the teachings of the invention.
Figure 2:
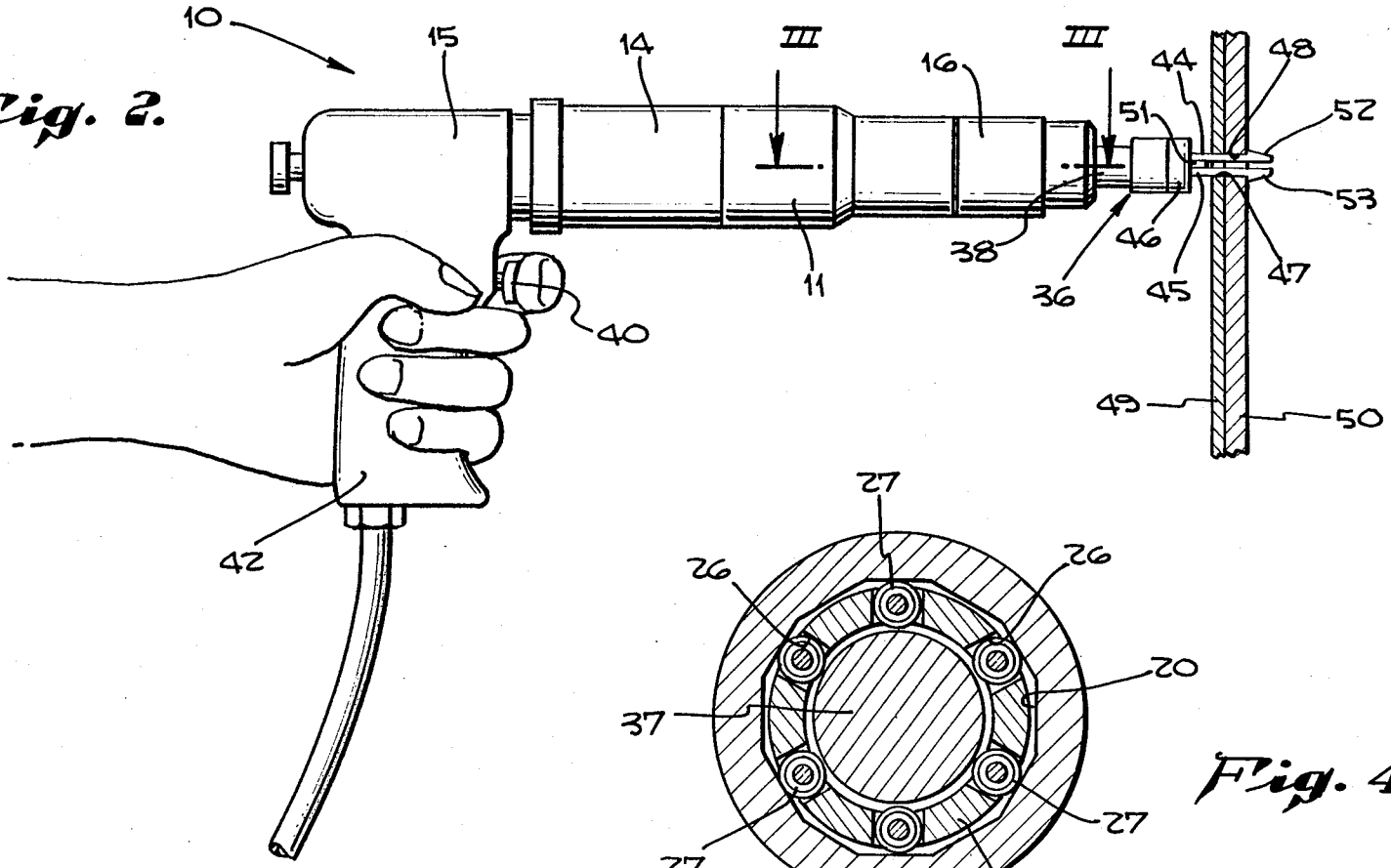
FIG. 2 is a vertical view of the complete installing tool of FIG. 1 shown installing a fastener.

Referring now to FIG. 1 of the drawing, a portion of an installing tool 10 is shown having a wrench portion 11 adapted to be threaded, via threads 12, to mating threads 13 on the housing 14 of a conventional drill motor 15 (see FIG. 2). A roller housing 16 is threaded, via threads 17, to threads 18 on the outside of a reduced diameter section 19 of wrench portion 11. Housing 16 includes an inner wall 20 which, as particularly contemplated in the present invention, is irregularly configured. For example, wall 20 may be polygonally-shaped, such as being twelve sided. A cage 21 is trapped within housing 16. Housing 16 (FIG. 1) may have a main inner wall portion 22 of one diameter and wall 20 may be of a reduced diameter receiving therein cage 21.

Cage 21 is retained in tool 10 by abutment at one end against the shoulder 23 formed at the intersection between wall portions 20, 22 and at the other end by abutment with the end wall 24 of the nut drive shaft housing 25 of wrench portion 11.

Figure 4:
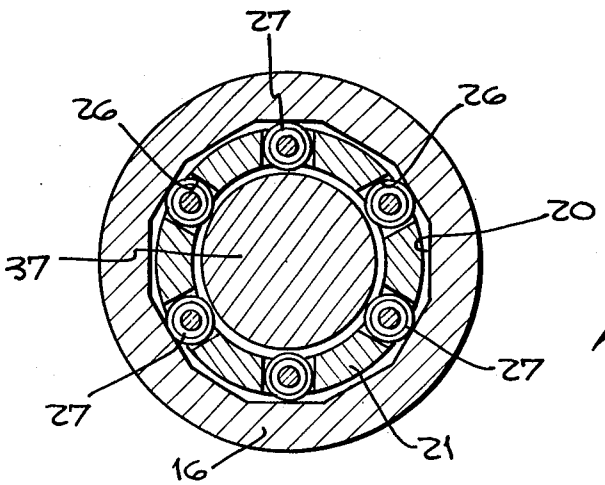
FIG. 4 is a view taken along lines IV—IV of FIG. 1.

Cage 21 is a cylindrical member having a plurality of elongated equally spaced openings 26 thereon (FIG. 4). For example, six such openings may be provided. A plurality of drive rollers 27 are provided in each opening 26 of a width greater than the width of openings 26 and disposed between cage 21 and wall 20. In this manner, as seen in FIG. 4, the rollers 27 extend through openings 26 in cage 21 but cannot pass therethrough.

Figure 3:
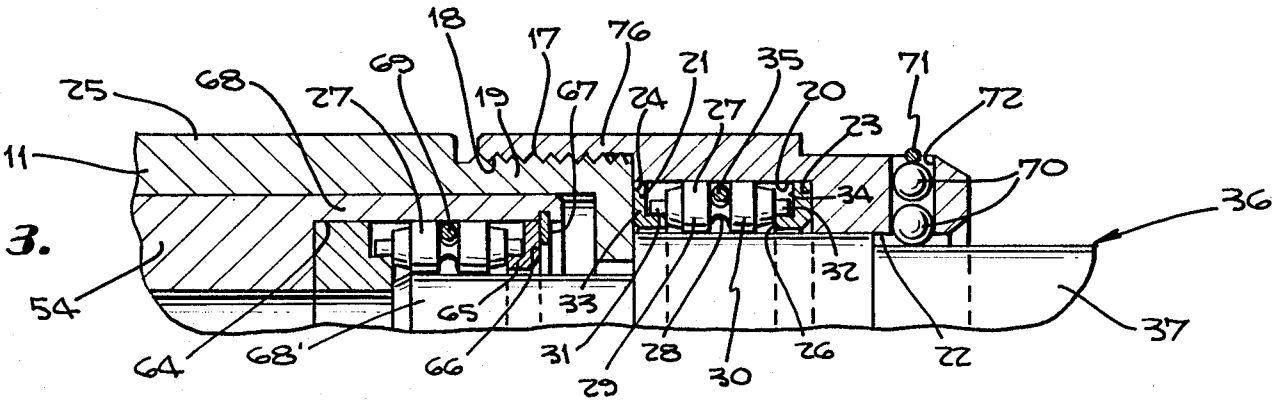
FIG. 3 is a view taken along lines III—III of FIG. 2.

As seen in FIG. 3, each roller 27 includes a reduced diameter mid-section 28 separating enlarged diameter roller sections 29 and 30. The ends of each roller section 29, 30 terminate in reduced ends 31, 32, respectively.

These ends 31, 32 are trapped between the end walls 33, 34 respectively, of cage 21 which abut against shoulder 23 and wall 24 as shown. Cage 21 is thus a cylindrical member having inwardly extending end flanges or walls 33, 34 (see also FIG. 4) and openings 26 therein.

As seen in FIG. 3, a conventional resilient spring, such as a garter spring 35, is disposed between each roller reduced section 28 and the wall 20. As also seen, particularly in FIGS. 1 and 3, a conventional wedging-type fastener 36 is shown disposed internally of tool 10. Fastener 36 has a first main body 37, cylindrical in cross-sectional (see particularly FIG. 4), of a first diameter gripped by tool 10. As can be seen in FIG. 4, the rollers 27 extend out of openings 26 and abut against body 37.

Fastener 36 also includes a body portion 38, of a lesser diameter than body portion 37, and also cylindrical, and a forward body portion 39 which may also be cylindrical and of diameter generally related to the diameter of body portion 37 and a forward carrier portion 46.

As seen in FIG. 2, the tool 10 includes the reversible, controllable torque motor 15 secured to the forward end of housing 14. The motor 15 is operated by a trigger 40 as is well known in the art. A similar tool is described in U.S. Pat. No. 3,263,320, the teachings of which are incorporated herein by reference.

Housing 14, and the drill motor output shaft 41 (FIG. 1), motor 15, and trigger 40 and handgrip 42 (FIG. 2) are all part of a conventional tool as is well known in the art. The shaft 41 includes a hex recess 43 for receiving therein the wrenching portion 11 of the tool. Fastener 36 also includes pins 44, 45 extending from carrier portion 46 of fastener 36 (FIGS. 1 and 2). Pins 44, 45 are shown extending through aligned openings 47, 48 (FIG. 2) in panels 49, 50, respectively, all as is well known in the art. A spreader 51 is disposed between pins 44, 45 as is well known in the art. The enlarged heads 52, 53 extend on the blind side of panels 49, 50, as shown.

The wrenching portion 11 also includes a nut drive shaft 54 disposed internally of the nut drive shaft housing 25. A cupped thrust washer 55, L-shaped in cross-section, is disposed between the drill motor housing 14 and nut drive shaft 54, separated by a conventional thrust bearing 56. A retaining ring 57 mounted in a reduced end section 58 of shaft 54 holds shaft 54 in position with respect to washer 55. A hexagonally shaped spline drive shaft 59, having an annular ring 60 thereon, is mounted in hex opening 43 and thus conforms thereto and is driven by shaft 41 when motor 15 is activated. Ring 60 abuts against the end wall 61 of shaft 41 and is biased by a compression spring 62 encircling shaft 59 between ring 60 and the end wall 63 of reduced portion 58 of shaft 54.

Shaft 54 has an inner cavity 64 of an inner wall configuration similar to wall 20. A nut roller cage 65 is mounted in cavity 64 having an end wall 66 abutting against a retaining ring 67 mounted in the thin wall portion 68 of shaft 54. It is to be understood that cage 65 is generally similar to cage 21 of FIGS. 1, 2, 3 and 4 and includes spaced openings similar to openings 26 and has rollers 27 mounted therein all as heretofore disclosed. These rollers 27, in cavity 64, as seen in FIG. 1, abut against a round or cylindrical shaft portion 68' of fastener 36. Finally, a spring 69, similar to spring 35, is provided between rollers 27, in cavity 64, and the inner wall thereof as shown.

To assist in the retention of fastener 36 within tool 10, a conventional ball lock is provided at the forward end of tool 10 in the form of trapped balls 70, retained therein by a body retainer ball spring 71. Balls 70 extend slightly out of openings 72 in the forward end of housing 16 but are of a lesser diameter so they are trapped therein. They retract against the bias of spring 71 when fastener 36 is inserted therein and, thus, retain fastener 36 in tool 10 until it is desired to remove the same as is well known in the art.

In operation, a fastener, such as fastener 6, which may have a cylindrical main body portion 37, is installed in the openings 47, 48 in panels 49,50. The operator now comes along with tool 10 with wrenching portion or housing 16 installed thereon. The housing 16 is inserted over the portion of fastener 36 protruding on the access side of panel 49 (on the left thereof in FIG. 2). The diameter of the interior opening of cage 21 is related to the diameter of the cylindrical portion 37 so that portion 37 is insertible into cage 21 in a close fitting relationship. Portion 68' enters cage 65. The motor 15 is now actuated to rotate output shaft 41 in a clockwise direction.

Such rotation forces or wedges rollers 27 against the irregularly shaped inner surface of cavity 64 locking the cage 65 in cavity 66. The rollers 27 also wedge against the cylindrical surface of cylindrical portion 68' thereby holding the cage 65 to the cylindrical captive nut 68' of the fastener 36 and thus rotating the fastener 36 to install the same as is well known in the art when the tool 30 is actuated to rotate shaft 59 and thus rotate nut drive shaft 54 while cage 21 holds portion 37 in a non-rotating relationship. After installation, the operator merely counter-rotates the fastener 26 in the same manner.

It can be seen that, in this manner, fastener 36 and any other similar wedging-type fastener, can be quickly and easily installed in or removed from panels 49, 50. The unique cage assembly and configuration of housing 11 provides for any misalignment of the tool 30 to the fastener body 37. It is not necessary that the fastener be precisely aligned with respect to the wrenching portion of the tool. The wrench portion can be provided separately for installation in a particular tool or as a complete tool assembly. The device disclosed herein lends itself to automatic insertion and removal of wedging-type fasteners, particularly those having cylindrical body portions.

I claim:

1. A power tool for rotationally driving a workpiece of the type having a first cylindrical outer member and a second cylindrical inner member which is concentrically mounted with respect to the outer member for relative rotation thereto and which projects axially therefrom, the tool being adapted to engage and disengage the workpiece by axial motion onto and off it, respectively, and being adapted, when engaged with the workpiece, to hold the outer member stationary relative to the tool while selectively applying torque to the inner member in either direction of rotation, the tool comprising:

a tool body;

a drive shaft rotatably mounted in said tool body for rotation about a central axis, said drive shaft including a generally tubular open end positioned to receive the inner member of the workpiece and extend in spaced relation therearound;

motor means mounted in said tool body for applying torque to said drive shaft to selectively rotate it in opposite directions;

a nosepiece attached to said tool body in concentric relation to said central axis, said nosepiece including a generally tubular open end positioned to receive the outer member of the workpiece at the same time that the inner member of the workpiece is received within the open end of said drive shaft, said open end of said nosepiece extending in spaced relation around the outer member of the workpiece; and inner and outer cylinder gripping means mounted in the open ends of said drive shaft and said nosepiece releasably gripping said inner and outer members of the workpiece, said inner and outer cylinder gripping means being engaged with and disengaged from the inner and outer members of the workpiece by axial motion of the tool onto and off the workpiece, respectively, rotation of said drive shaft in one rotational direction causing said inner cylinder gripping means to grip the inner member rotating it in the one direction and causing said outer cylinder gripping means to grip the outer member and hold it against rotation, while rotation of said drive shaft in the other rotational direction without disengaging the workpiece causing said inner cylinder gripping means to grip the inner member rotating it in the other direction and causing said outer cylinder gripping means to grip the outer member and hold it against rotation.

2. A tool as defined in claim 1, wherein each of said cylinder gripping means comprises:

a plurality of gripping elements movably mounted to the associated one of said nosepiece and said drive shaft for limited peripheral and radial movement within and relative to the associated open end between a first position at an outer radial spacing from said central axis and second and third positions spaced a predetermined peripheral distance on opposite sides of said first position at an inner radial spacing from said central axis which is relatively closer thereto;

mounting means supporting said gripping elements for such limited peripheral and radial movement within the associated one of the open ends; and said gripping elements in said first position engaging the surface of the associated one of the inner and outer members of the workpiece sufficiently loosely to enable the tool to be pushed axially onto, and pulled axially off, the workpiece, said gripping elements being moved by turning motion applied to said drive shaft to either said second or third positions, dependent upon the direction of rotation, in which the radially inward motion of said gripping elements engages them so tightly with the inner and outer members that the outer member is held stationary relative to the tool body while the inner member is rotated in fixed engagement with said drive shaft.

3. A tool as defined in claim 1, wherein each of said cylinder gripping means comprises, an inner, peripherally extending wall on the associated one of said open ends, said wall having a plurality of diametrically opposed spaced flat surfaces, each flat surface and its peripherally adjacent neighbor meeting at an intersection which is spaced a greater radial distance from the central axis than the centers of said flat surfaces;

a cage positioned within the associated one of said open ends;

a plurality of pairs of diametrically spaced axially extending rollers mounted in said cage, said rollers being positioned within at least some of the intersections between said flat surfaces for limited radial movement toward and away from said central axis;

means connected to said cage for biasing said rollers in a radially inward direction;

said rollers, when positioned in said intersections, having sufficiently loose engagement with the surface of the associated one of the inner and outer members of the workpiece to permit axial engagement and withdrawal of the workpiece relative to the tool, respectively, application of torque in either direction of rotation, when the tool is engaged with the workpiece, moving at least one of said pairs of rollers sufficiently far along the adjacent flat surfaces to grippingly engage the associated one of the members of the workpiece so that the outer member is held stationary relative to the tool while the torque applied to said drive shaft by said motor means is transmitted to the inner member of the workpiece.

4. A tool as defined in claim 3, wherein there are at least three rollers mounted in the cage.

5. A tool as defined in claim 3, wherein there are twelve flat surfaces on each of the inner walls of the associated open ends of said drive shaft and said nosepiece, and wherein there are six rollers mounted in said cage.

6. A tool as defined in claim 3, wherein each of said rollers comprises a substantially cylindrical roller element having two substantially cylindrical outer body sections of a first diameter separated by a central body section of a smaller diameter than said first diameter.

7. A tool as defined in claim 6, wherein said means for biasing said rollers in a radially inward direction comprises a garter spring positioned around the central body section of each of said rollers.

8. In combination, a workpiece and a power tool for rotationally driving the workpiece, the combination comprising:

a first cylindrical outer member on the workpiece;

a second cylindrical inner member on the workpiece projecting axially from the outer member and being concentrically mounted with respect to the outer member for relative rotation thereto;

a tool body;

a drive shaft rotatably mounted in the tool body for rotation about a central axis, the drive shaft including a generally tubular open end positioned to receive the inner member of the workpiece and extend in spaced relation therearound;

a motor means mounted in the tool body for applying torque to the drive shaft to selectively rotate it in opposite directions;

a nosepiece attached to the tool body in concentric relation to the central axis, the nosepiece including a generally tubular open end positioned to receive the outer member of the workpiece at the same time that the inner member of the workpiece is received within the open end of the drive shaft, the open end of the nosepiece extending in spaced relation around the outer member of the workpiece; and inner and outer cylinder gripping means mounted in the open ends of said drive shaft and said nosepiece releasably gripping said inner and outer members of the workpiece, said inner and outer cylinder gripping means being engaged with and disengaged from the inner and outer members of the workpiece by axial motion of the tool onto and off the workpiece, respectively, rotation of said drive shaft in one rotational direction causing said inner cylinder gripping means to grip the inner member rotating it in the one direction and causing said outer cylinder gripping means to grip the outer member and hold it against rotation, while rotation of said drive shaft in the other rotational direction without disengaging the workpiece causing said inner cylinder gripping means to the inner member rotating it in the other direction and causing said outer cylinder gripping means to grip the outer member and hold it against rotation.

9. A tool for installing and removing fasteners of the type having axially spaced first and second tool gripping surfaces which are rotated relative to each other to install the fastener in or remove the fastener from a panel, said tool comprising:

a main tool housing;

a motor connected to said housing, said motor having an output shaft for rotation in either rotational direction along a central axis of said tool;

a generally tubular first wrenching portion connected to said housing, said first wrenching portion having an inner wall having a plurality of camming surfaces, a substantially cylindrical cage positioned concentrically with respect to said inner wall, a plurality of rollers mounted in said cage, said rollers being adapted to dialate sufficiently to fit over and engage said first wrenching portion of the fastener when the fastener is inserted into said first wrenching portion of said tool; and means for biasing said rollers toward the central axis of said tool;

a generally tubular second wrenching portion spaced axially from said first wrenching portion and connected to said output shaft for rotation therewith, said second wrenching portion having an inner wall having a plurality of camming surfaces, a substantially cylindrical cage positioned concentrically with respect to said inner wall, a plurality of rollers mounted in said cage, said rollers being adapted to dialate sufficiently to fit over and engage said second wrenching portion of the fastener when the fastener is inserted into the second wrenching portion of said tool, and means for biasing said rollers toward the central axis of said tool; and means for actuating said motor to rotate said shaft and said second wrenching portion in either rotational direction, application of torque in either rotational direction causing said rollers of said second wrenching portion to move a limited distance into wedging engagement against said camming surfaces of said inner wall of said second wrenching portion stopping movement of said cage and causing said rollers to grip the second tool gripping surface of the fastener and rotate the second tool gripping surface in the direction of rotation of said output shaft, while said rollers of said first wrenching portion move a limited distance into wedging engagement against said camming surfaces of said inner wall of said first wrenching portion stopping movement of said cage and causing said rollers to grip the first tool gripping surface of the fastener and hold the first tool gripping surface against rotation to set the fastener.

* * * * *